United States Patent [19]

Govan

[11] Patent Number: 4,544,363

[45] Date of Patent: Oct. 1, 1985

[54] LINE CUTTER FOR OUTBOARD AND INBOARD/OUTBOARD MOTORS

[76] Inventor: Donald T. Govan, P.O. Box 350246, Ft. Lauderdale, Fla. 33335

[21] Appl. No.: 713,301

[22] Filed: Mar. 18, 1985

[51] Int. Cl.[4] ..... B63H 5/16

[52] U.S. Cl. ..... 440/73; 416/146 R

[58] Field of Search ..... 440/73, 71; 114/222; 416/146 R, 146 B; 83/673, 675, 508, 509, 508.3; 56/255, 295

[56] References Cited

U.S. PATENT DOCUMENTS

| | | | |
|---|---|---|---|
| 732,568 | 6/1903 | Lee | 440/73 |
| 756,031 | 3/1904 | Lee | 440/73 |
| 1,390,397 | 9/1921 | Svenson | 416/146 R |
| 3,371,720 | 3/1968 | Blanchard | 416/146 B |
| 4,211,515 | 7/1980 | Henrich | 416/146 R |

FOREIGN PATENT DOCUMENTS

| | | | |
|---|---|---|---|
| 256544 | 11/1969 | U.S.S.R. | 440/73 |

*Primary Examiner*—Trygve M. Blix
*Assistant Examiner*—C. T. Bartz
*Attorney, Agent, or Firm*—Ronald E. Smith

[57] ABSTRACT

A device mounted in encircling relation to a propeller shaft. The device cuts lines, nets and weeds, thus preventing entanglement of the propeller and preventing entanglement damage which may result to the parts of the driven assembly of outboard motor and inboard/-outboard motor vessels. The device includes a non-rotatable, annular cutting member, having one double-edged cutting blade, that is disposed in sandwiched relation to two rotatable annular members. One of the rotatable members carries no cutting blades, and the second rotatable member carries three double-edged, circumferentially spaced blades that individually cooperate with the non-rotatable blade in a shearing action. The blade-carrying rotatable member includes a concentric mounting ring that is offset toward the propeller shaft housing, and the offset defines a centrally apertured projecting portion which aperture is in the form of a tapered seat that mates with a corresponding taper formed on the propeller shaft. When the mount nut for the propeller is tightened, the forward flat face of the propelleris driven into firm abutting relation to the blade-carrying rotatable member anddrives the taper formed therein firmly into wedging engagement with the taper onthe propeller shaft so that both rotatable cutter members will rotate conjointlywith the shaft. The projecting portion of the rotatable member defines an annular shelf which positions the non-rotatable cutter member.

13 Claims, 4 Drawing Figures

LINE CUTTER FOR OUTBOARD AND INBOARD/OUTBOARD MOTORS

BACKGROUND OF THE INVENTION

1. Field of the Invention

This invention relates to devices that cut lines, nets and weeds from the propellers of vessels, and more particularly relates to a device having utility in both outboard motor applications and in inboard/outboard motor applications.

2. Description of the Prior Art

The inventor of the subject invention has been awarded U.S. Pat. Nos. 4,447,215 and 4,507,091, for propeller protecting devices. These devices represent the prior art containing the teachings of most relevance to the subject invention. However, both of the earlier devices had application in the environment of inboard motors, whereas the present invention has utility in the environment of outboard and inboard/outboard motors. The earlier inventions and the present invention share the same principle of operation, however.

Lines, nets and weeds are commonly encountered by vessels. Unfortunately, they are invariably swept by the propeller blades into the very part of the propeller assembly where they can do the most harm, i.e., the space where the propeller cowling meets the lower housing from which extends the propeller shaft. Lines enter the space between the cowling and lower housing and wrap around the oil seals therein until they cut through such seals. This results in oil leakage into the water and of course requires the installation of new oil seals.

A device is needed that will prevent lines, nets and weeds from entering into any space where they can cause environmental pollution and expensive-to-repair damage. The needed device would cut the lines as they are fed by the propeller blades to the cutting station.

SUMMARY OF THE INVENTION

The need for a propeller protecting device capable of cutting objects, such as lines, nets, weeds and the like, that commonly befoul outboard and inboard/outboard propellers, is fulfilled by a device having four (4) primary components, namely (1) a rotatable ring-shaped member having no cutting blades formed thereon, (2) a rotatable ring member having a plurality of circumferentially spaced blades formed thereon, (3) a substantially non-rotatable ring member having a single cutting blade formed thereon, which third member is positioned between the other two members, and which cutting blade has a forwardly extending tongue or male portion, and (4) a keeper bracket or female wedge that receives the male portion of the substantially non-rotatable cutting blade.

Of the four (4) primary components, one component in particular, the blade-carrying rotatable ring member, is of unique design. It has a first outer ring, a second, concentric ring radially inward thereof and radial legs that interconnect such rings. The inner ring protrudes in a longitudinal direction toward the propeller shaft housing so that it is not coplanar with the outer ring. The protrusion or offset provides an annular mounting surface for the non-rotatable ring member. Moreover, the inner ring is centrally apertured and the aperture is in the form of a tapered surface that seats with a corresponding taper formed on the propeller shaft, and the radial legs that interconnect the inner and outer rings are provided with a taper that is spaced apart from a corresponding taper on the propeller hub. In this manner, the forward facing flat surface of the propeller directly abuts the rearward facing flat surface of the inner ring portion of the rotatable blade-carrying annular cutting ring. Thus, as the propeller mount nut is axially advanced in a forwardly direction, the propeller drives the inner or mounting ring forwardly so that its central taper is driven in a wedging action onto the taper of the propeller shaft. This assures conjoint rotation of the propeller shaft and the rotating parts of the novel assembly.

The component just described preferably carries three circumferentially spaced, double edged blade members. The blades cooperate in a shearing action with the single cutting blade carried by the substantially stationary cutter ring member. The stationary blade has a forwardly projecting tongue or male wedge projection that projects into a wedge-shaped cavity or female wedge that is defined by a pair of keeper brackets, also called a wedge holding block, that are fixedly secured to opposite sides of the lower end housing leg of the motor assembly. The keeper brackets could be formed as a single unit, however.

The stationary cutter ring is disposed intermediate the first-described, three bladed cutting member and an annular bolt ring that rotates conjointly with the three bladed cutting member. It is positioned and supported by the projecting or offset portion of the three bladed cutting ring, as aforesaid, and bearing material is disposed on the interface between the inner circumference of the single bladed ring and the outer circumference of the projecting portion.

As in the earlier propeller protecting devices invented by the inventor of the subject invention, the rotating and non-rotating blades accomplish the desired line and net cutting in a shearing action. The wedge holding block cooperates with the male wedge projection on the non-rotating blade to maintain the non-rotatable blade in its stationary position. However, at the instant a resistance load appears on the blades, the rotating and non-rotating cutting blades are driven into shearing relation with one another by the wedging engagement of said wedged surfaces. In this manner, the rotating blades are free to rotate relative to the stationary blade at all times the propeller area is free of lines and other obstructions. The presence of an obstruction places a load on the blades, however, which load immediately drives the rotating blades forwardly into a shearing engagement with the non-rotating blade. Due to the wedging action between the wedge holding block and the male projection of the non-rotating blade, the amount of shearing force provided between the blades increases instantaneously and in direct proportion to the amount of load applied to the blades.

It is the primary object of this invention to provide a line, net and weed cutter for use with outboard motors and inboard/outboard motors. with an assembly that is easy to install, and that will sit squarely relative to the propeller shaft and hub.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Throughout this description, the terms "forward" and "rearward" shall refer to the left and right, respectively, of all FIGS.

Figure 1:
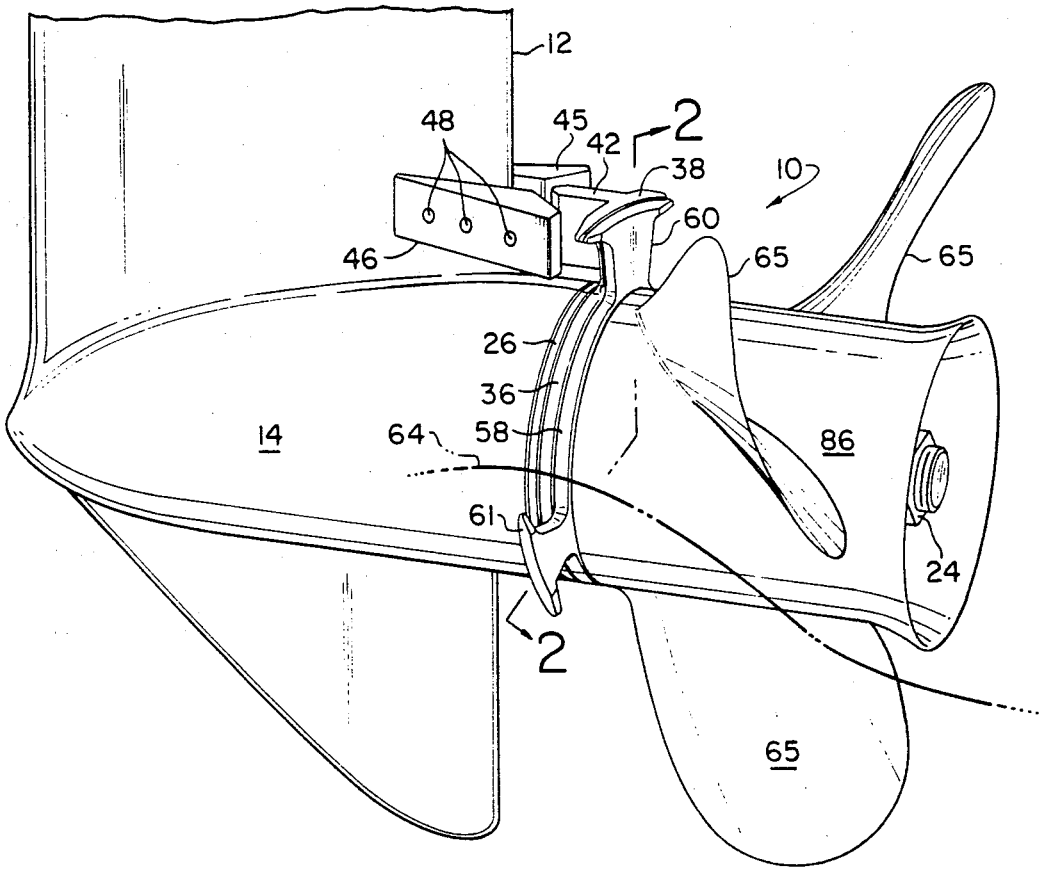
FIG. 1 is a perspective view that shows the assembly of this invention installed on an outboard or an inboard/outboard motor assembly.

Referring briefly to FIG. 1, it will there be seen that the invention in its assembled configuration and operative placement is indicated by the reference numeral 10 as a whole.

The lower end of the motor assembly 12 depends to the hull or keel of a boat, not shown. The strut 12 has a propeller shaft housing 14 that terminates in a circular opening that is shown best in FIG. 4. Still referring to FIG. 4, propeller shaft 16 having its axis of rotation at the center of the housing 14 is shown and is seen to have an annular taper 18 formed therein. The taper 18 reduces the diameter of the shaft 16, as illustrated, and a large portion of the reduced diameter shaft is female splined as at 20 in FIG. 2, said female spline engaging a corresponding male spline formed in the inner propeller hub 22. A commercial embodiment of the propeller hub if formed of rubber to protect the motor assembly when the propeller strikes rocks and other hard objects, and is known as a rubber cushion hub. The rubber is depicted in FIG. 2 by very bold lines and surrounds the inner propeller hub 22.

Figure 2:
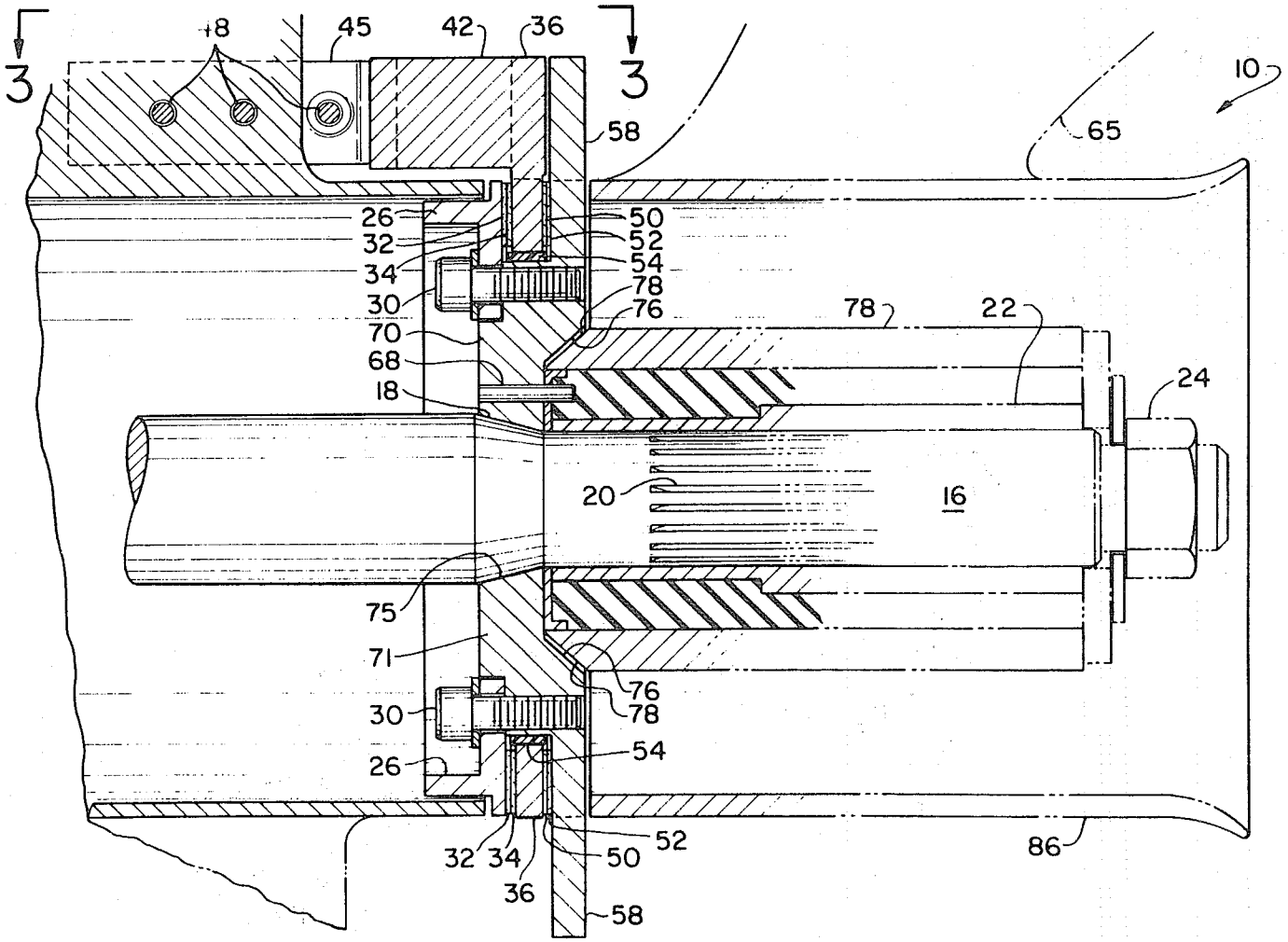
FIG. 2 is a sectional view taken along line 2—2 of FIG. 1.

The distal or rearward end of shaft 16 is threaded as shown to receive a mount nut 24 which is also shown in FIG. 2. The inventive assembly lengthens the propeller assembly by approximately one inch (1"). To compensate for this additional length, one inch (1") of the forward facing surface of the propeller hub is removed by cutting. The vertical line immediately to the left of the reference numeral 20 in FIG. 2 is the cutting line, and the annular surface defined thereby will be referred to as the abutment surface. With this modification to the propeller, the assembly will fit entirely within cowling 86, as desired, as shown in both FIGS. 1 and 2.

A bolt ring 26 (FIG. 4) includes three (3) equidistantly and circumferentially spaced aperture defining members 28 through which extend bolt members collectively designated 30. As will become clear as this description proceeds, the bolts 30 unite the bolt ring 26 and the rotatable cutter ring so that they rotate conjointly.

A first pair of annular face wear bearing members 32 and 34 are disposed between the bolt ring 26 and non-rotatable cutter ring 36. Face wear bearing 32 is secured as by a suitable mastic to bolt ring 32, and face wear bearing 34 is similarly secured to cutter ring 36. The bearing members are formed of alumina ceramic having a Rockwell C-scale harness of 76.

Cutter ring 36 has a single double edged blade member 38 integrally formed therewith. Blade 38 has ramped ears 39, 40, the function of which is described in both of the inventor's patents mentioned hereinabove.

Figure 4:
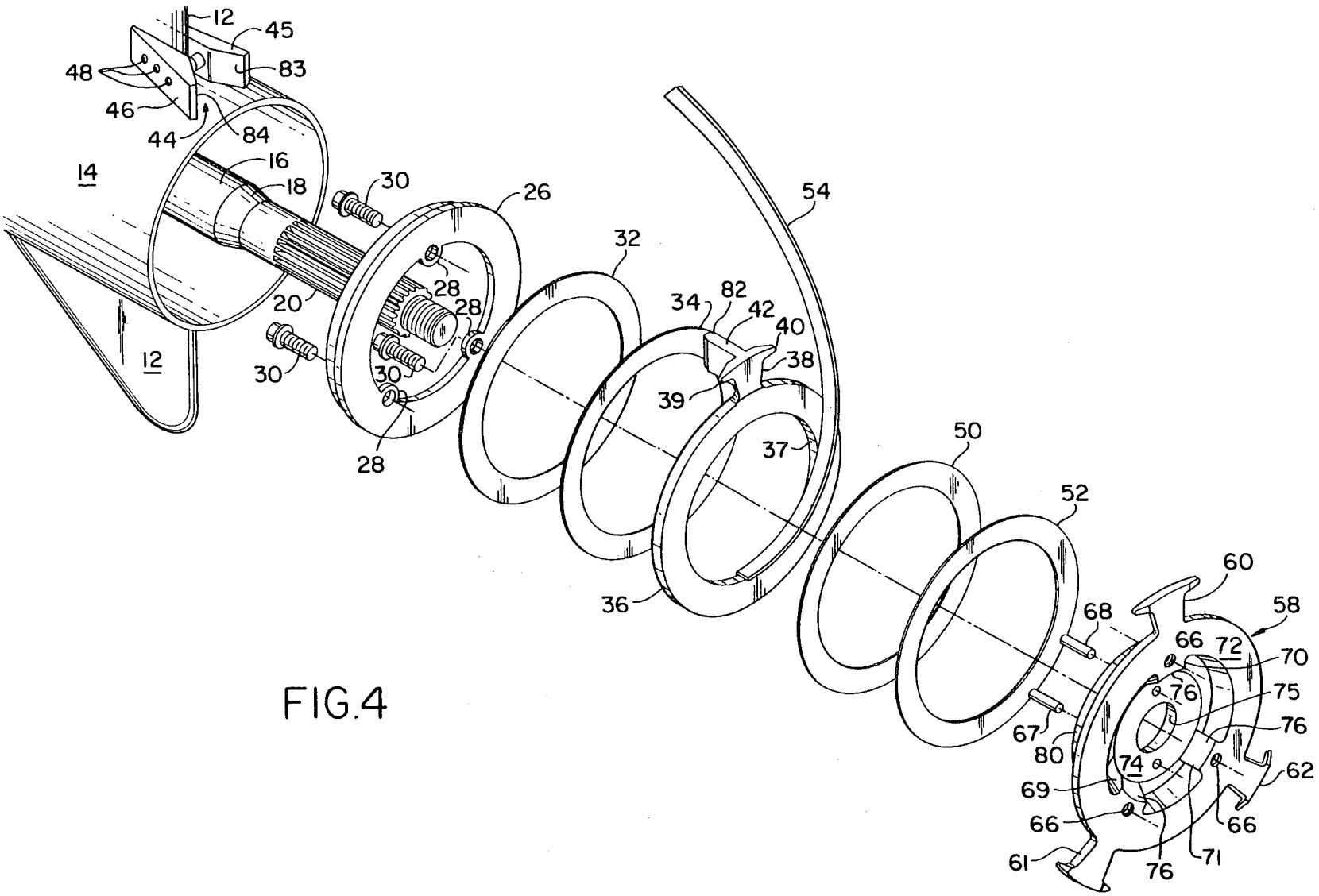
FIG. 4 is an exploded isometric view of the subject invention.

Male wedge projection 42 extends forwardly from blade 38, and extends into female wedge cavity 44 formed by the wedge holding block members 45, 46 illustrated at the upper left corner of FIG. 4.

Figure 3:
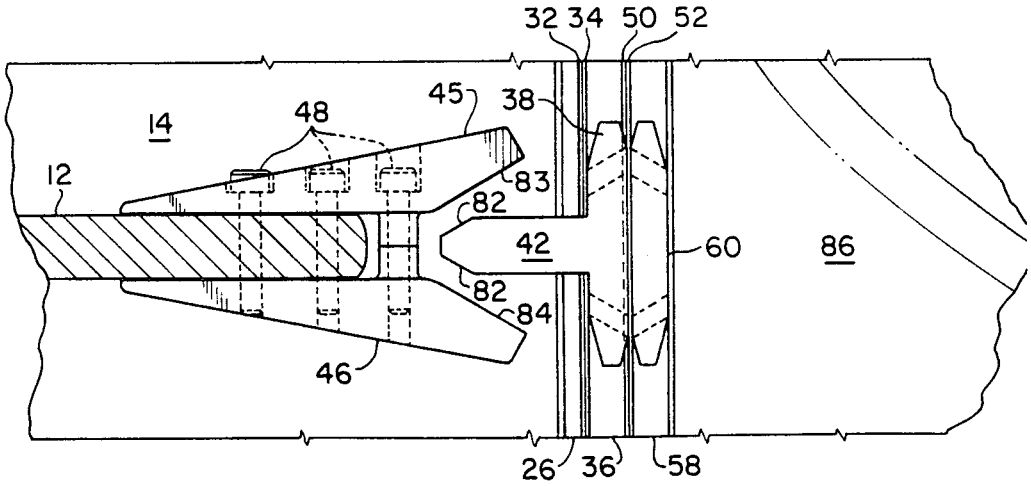
FIG. 3 is a partial plan view taken along line 3—3 of FIG. 2.

Wedge holding block members 45, 46 are fixedly secured to strut 12 by bolts 48 as is perhaps best shown in FIG. 3. The interaction of the male wedge projection 42 and the wedge holding block members 45, 46 is described more fully hereinafter.

A second pair of alumina ceramic face wear bearings 50 and 52 are bonded by a suitable mastic to member 36 and to rotatable cutter ring 58, respectively. The preferred bonding agent is "Marine Tex" which is an epoxy that is not water-soluble.

It is worth noting that the alumina ceramic face wear bearings 32, 34, 50, 52 may be replaced by bearings having reduced wear capabilities in installations where low speeds and low propeller rpms are expected. A suitable material in reduced wear applications is Ryton 4, a product of Phillips Petroleum Company.

A third bearing member 54 when operatively installed overlies the inner circumferential surface 37 of the cutter ring 36. The first and second pair of ceramic bearing members and the third bearing members 32, 34, 50, 52 and 54 are perhaps best shown in their operative positions in FIG. 2.

Rotatable cutter ring 58 carries three double-edged blades 60, 61 and 62 that cooperate with blade 38 of cutter ring 36 to shear lines, nets or weeds that are encountered by the boat's propeller. The elongate line 64 appearing in FIG. 1 represents a typical line of the type that could entangle and disable a propeller in the absence of the subject device. The blades 65 of the propeller perform a sweeping action that presents the line 64 to the blades 38 and 60–62 so that it can be sheared.

Referring again to FIG. 4, the internally threaded bores 66 formed in the cutter ring 58 receive bolts 30 so that elements 26, 36 and 58 form a unit. The large nut 24, mentioned earlier in connection with FIG. 2 but also shown in FIG. 1, retains the assembled device on the propeller shaft 16. Locator pins 67 and 68 (FIG. 4) position the cutter ring 58 and its blades 60–62 relative to the propeller blades. In this manner, the blades 60–62 will be properly positioned relative to the propeller blades. As shown in FIG. 2, the locator pins extend into the propeller hub 78. Thus, where a very thick cable or other non-shearable obstruction is encountered, the pins 67, 68 will shear off at the abutment surface so that the driven assembly of the vessel will not be subjected to damage.

As shown in FIG. 4, cutter 58 includes three radial legs 69–71 that interconnect the outer ring 72 thereof with an inner ring 74 of smaller diameter. The central aperture 75 of inner ring 74 is tapered to correspond with the taper 18 on the propeller shaft 16 as is best seen in FIG. 2. Moreover, each of the radial legs 69–71 are provided with a taper, collectively designated 76, (FIG. 4) as well, which tapers accommodate a corresponding circumferential taper on the forward end of the propeller hub 78 as best shown in FIG. 2. The tapers 76 and 78 do not seat against one another. The openings between the radial legs 69–71 allow gasses to pass through the assembly.

The inner ring 74 projects forwardly of the plane of the outer ring 72, as is depicted both in FIGS. 2 and 4. This forward projection defines an annular shelf 80 which accommodates non-rotatable cutter ring 36 as is perhaps best understood in connection with FIG. 2 where bearing strip 54 is shown positioned in friction reducing relation between the inner circumferential surface 37 of cutter ring 36 and the outer circumferential surface of the projection 80.

In a commercial embodiment of the invention, when no resistive load is on the blades, the longitudinal spacing between the rotating and the non-rotating blades is between eight thousandths and fifteen thousandths of an inch (0.008"–0.015"), approximately, which spacing is exagerrated in FIG. 2 so as to be clearly visible.

Referring now to FIG. 3, it is there shown how the substantially non-rotatable cutter ring 36 is maintained against rotation by the interaction of the male wedge 42 and the keeper brackets 45, 46. When a ship equipped with the device 10 is under way in a forward direction, the cutter rings 36 and 58 will begin rotation with the propeller shaft 16. This will result in an initial displacement of blades 38 and 60–62 in an upwardly direction or toward the top of the page upon which FIG. 3 appears. When the propeller is operated in its reverse mode, the initial displacement of blades 38 and 60–62 will be toward the bottom of the page. In either event, rotating ring 58 will continue its rotation as its path of travel will be unimpeded. Male wedge projection 42, however, will rotate until it impinges against either keeper bracket 45 or 46, depending upon the direction of propeller rotation, of course, and, accordingly, non-rotatable cutter ring 36 will rotate no further. The angle of the male wedge 42 at 82 corresponds to the angle on surfaces 83 and 84 of keeper brackets 45, 46, respectively. The preferred angle is about thirty (30) degrees. Thus, at the instant a load is placed on the assembly 10, as by a net or other impediment to propeller rotation, blades 38 and 60–62 will be driven together. If the force of rotation of the propeller either toward the top of the page or the bottom is thought of as a vertical vector having the appropriate direction and the axial force acting upon the shearing blades 38 and 60–62 is thought of as a horizontal vector of appropriate direction, then the resultant force of the keeper bracket 45 or 46 on the male wedge 42 will be understood as the sum of such vectors. The position of the parts shown in FIG. 3 is of course prior to shaft rotation since surfaces 82, 82 are not abutting either wedge holding block 45 or 46. The space between the distal or forward end of the male projection member 42 and the wedge holding block is provided to permit end play of the propeller shaft when the vessel is underway.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall between.

Now that the invention has been described,

What is claimed is:

1. An apparatus that cuts lines, nets and weeds of the type that may be encountered by propeller driven vessels of outboard and inboard/outboard design when under way, said vessels of the type where the propeller is mounted to a rotatable propeller shaft that extends rearwardly from a propeller shaft housing that depends to a vessel's hull, comprising:

keeper bracket means fixedly secured to said propeller shaft housing, said keeper bracket means configured to define a rearwardly opening wedge-shaped cavity, a non-rotatably mounted annular cutter ring disposed transversely to said propeller shaft, in encircling relation thereto, a cutting blade member mounted on said cutter ring, a pair of shear edges formed on opposite sides of said cutting blade member, a projecting wedge-shaped member formed on said cutting blade member and extending in a forward direction into the rearwardly-opening cavity defined by said keeper bracket means, a rotatably mounted annular bolt ring disposed intermediate said cutter ring and said propeller shaft housing, a rotatably mounted annular cutter ring mounted rearwardly of said non-rotatably mounted cutter ring so that said non-rotating cutting ring is disposed in sandwiched relation to said bolt ring and said rotatable cutter ring, a plurality of circumferentially spaced cutting blade members mounted on said rotatable cutter ring, a pair of shear edges formed on opposite sides of each of said plurality of cutting blade members, said propeller shaft having a taper formed therein, a centrally apertured inner ring member of reduced diameter formed as a part of said rotatable cutter ring, said central aperture configured in the form of a taper that corresponds to the taper formed in the propeller shaft, said projecting wedge member entering into abutting engagement with said keeper bracket means attendant rotation of said propeller shaft, said projecting wedge member entering into firm wedging engagement with said keeper bracket means substantially instantaneously upon the introduction of a load on said apparatus, and said taper formed in said central aperture of said inner ring being driven onto the taper formed in the propeller shaft attendant tightening of said propeller onto said propeller shaft by a mount nut.

2. The apparatus of claim 1, further comprising, a forwardly extending annular ledge member formed on said rotatable cutter ring, said ledge member having an outside diameter less than the inside diameter of said non-rotatable cutter ring, a strip of bearing material disposed in overlying relation to said ledge member, said non-rotating cutter ring having an inside diameter sufficient to snugly receive therein said ledge member and said bearing material, said ledge member maintaining said non-rotating cutter ring in its correct operative alignment with said rotatable cutter ring and said bolt ring.

3. The apparatus of claim 2, further comprising, said inner ring member lying in a vertical plane forwardly of the plane of said rotatable cutter ring member, a plurality of radial leg members interconnecting said inner ring member and said rotatable cutter ring member, a propeller hub having a taper formed therein, and a taper formed on the rearward side of said rotatable cutter ring that corresponds to the taper formed on said propeller hub, said hub taper and said cutter ring taper disposed in spaced relation to one another.

4. The apparatus of claim 3, further comprising, a first annular face wear bearing member fixedly adhered to a rearward facing surface of said annular bolt ring and a second annular face wear bearing member fixedly adhered to a forward facing surface of said non-rotatable annular cutter ring, a third annular face wear bearing member fixedly adhered to a rearward facing surface of said non-rotatable annular cutter ring and a fourth annular face wear bearing member fixedly adhered to a forward facing surface of said rotatably mounted annular cutter ring.

5. The apparatus of claim 4, wherein said first, second, third and fourth annular face wear bearing members are formed of ceramic.

6. The apparatus of claim 5, wherein said first, second, third and fourth annular face wear bearing members are formed of alumina ceramic.

7. The apparatus of claim 2, further comprising, a plurality of circumferentially spaced aperture members formed in said annular bolt ring, a plurality of circumferentially spaced aperture members formed in said rotatable cutter ring, and a plurality of bolt members adapted to secure said annular bolt ring to said rotatable cutter ring.

8. The apparatus of claim 7, further comprising, a plurality of circumferentially spaced aperture members formed in said inner ring member of reduced diameter, a plurality of locator pin members, a plurality of bore members formed in a propeller hub, said locator pin members extending through said inner ring member apertures and into said hub bore members to position the blades of said rotatable cutter ring relative to the propeller blades and to provide a shearing means whereby damage to the driven assembly of the vessel can be avoided.

9. The apparatus of claim 1, wherein the angle of the wedge-shaped cavity defined by said keeper bracket means and said forwardly projecting wedge-shaped member is approximately thirty (30) degrees.

10. The apparatus of claim 1, wherein approximately one inch (1") of a forwardly projecting portion of the propeller hub is removed by cutting the same in a plane orthogonal to the axis of rotation of said propeller shaft to accommodate the apparatus within a propeller cowling.

11. The apparatus of claim 1, wherein the spacing between the rotatable and non-rotatable cutting blade members is between eight thousandths and fifteen thousandths of an inch (0.008"–0.015") when the apparatus is operating in the substantial absence of a resistive load thereon.

12. The apparatus of claim 11, wherein the rotatable and non-rotatable cutting blade members are driven together substantially instantaneously responsive to the introduction of a resistive load thereon.

13. The apparatus of claim 1, said apparatus positioned between the rearmost surface of said propeller shaft housing and the forwardmost surface of a propeller hub, thereby occupying and closing the space otherwise existing therebetween and thereby preventing the entry of lines and other articles from entering into said space and cutting oil seals and the like therewithin.

* * * * *